United States Patent [19]

Ohara

[11] Patent Number: 4,833,435

[45] Date of Patent: May 23, 1989

[54] ELECTROMAGNETIC RELAY

[75] Inventor: Masaharu Ohara, Yamaga, Japan

[73] Assignee: Omron Tateisi Electronics Co., Kyoto, Japan

[21] Appl. No.: 105,357

[22] Filed: Oct. 7, 1987

[30] Foreign Application Priority Data

Oct. 8, 1986 [JP] Japan ..... 61-240038

[51] Int. Cl.[4] ..... H01F 7/00; H01F 7/08

[52] U.S. Cl. ..... 335/265; 335/119; 335/128

[58] Field of Search ..... 335/78–85, 335/124, 119, 121, 128, 261, 265, 276

[56] References Cited

U.S. PATENT DOCUMENTS

| | | | |
|---|---|---|---|
| 2,632,820 | 3/1953 | Gauvreau | 335/265 |
| 4,254,391 | 3/1981 | Gould | 335/119 |
| 4,682,133 | 7/1987 | Kern | 335/128 |

FOREIGN PATENT DOCUMENTS

| | | | |
|---|---|---|---|
| 0211446 | 8/1986 | European Pat. Off. . | |
| 2115030 | 3/1971 | Fed. Rep. of Germany | 335/265 |
| 7516635 | 2/1977 | Fed. Rep. of Germany . | |
| 2204870 | 5/1974 | France . | |

*Primary Examiner*—E. A. Goldberg
*Assistant Examiner*—Lincoln Donovan
*Attorney, Agent, or Firm*—Wegner & Bretschneider

[57] ABSTRACT

An electromagnetic relay having a double armature structure comprises: an electromagnet; a pair of armatures which are individually rotatably arranged at the right and left positions of the electromagnet and are symmetrically rotated by the attractive forces of the electromagnet against a return spring; and a pair of contact mechanisms which are closed or opened by the rotation of the armatures. The electromagnet has a pair of iron cores to respectively attract the pair of armatures, or has a single iron core and respectively adsorbs the pair of armatures at both ends of this iron core. With this relay, even if one of the contact mechanisms was not open due to the melt-bonding, the other is opened.

2 Claims, 4 Drawing Sheets

PRIOR ART

ELECTROMAGNETIC RELAY

BACKGROUND OF THE INVENTION

1. Field of the Invention

The present invention relates to an electromagnetic relay and, more particularly, to an electromagnetic relay having a double armature structure.

2. Prior Art Statement

FIG. 6 is a perspective view of a conventional electromagnetic relay of the double pole type. In this electromagnetic relay, an electromagnet 52 is attached to a standing portion 51*a* of a yoke 51 over a base 50. One armature 53 is pivotably supported by a hinge to the edge of a front projecting portion 51*b* formed at the upper portion of the yoke 51. When a current is supplied to the electromagnet 52, the armature 53 is attracted to the electromagnet 52 and is rotated, so that contacts of both of right and left contact mechanisms 55 are closed. On the contrary, when the current supply to the electromagnet 52 is stopped, the armature 53 is rotated and returned by a return spring 54, so that both of the contact mechanisms 55 are open.

However, in such an electromagnetic relay, if one of the contact mechanisms 55 is not opened because, for example, the contacts were fused and bonded, the other contact mechanism 55 is also held in the closed state. Therefore, as shown in FIG. 7, when such contact mechanisms 55 are used as a double pole single throw switch in a power supply circuit of an electric apparatus 56, there is a problem such that even if the operator desires to disconnect the power supply circuit, a current continuously flows through the electric apparatus 56 by the foregoing melt-bonding of the contacts.

On the other hand, as shown in FIG. 8, if two electromagnetic relays of the single pole type each using one contact mechanism 55 in the electromagnetic relay shown in FIG. 6 are used, the foregoing problem can be solved. However, in this case, there is a problem of an increase in cost. A constitution of FIG. 8 is similar to that of FIG. 6 except a different point such that one of the contact mechanisms 55 in FIG. 6 is omitted, so that the same parts and components as those shown in FIG. 6 are designated by the same reference numerals and their descriptions are omitted.

SUMMARY OF THE INVENTION

The present invention is made in consideration of such circumstances and it is an object of the invention to provide an electromagnetic relay in which the manufacturing cost is low and even if one of the contact mechanisms was not be unexpectedly opened, the other contact mechaism can be opened.

To accomplish this object, an electromagnetic relay according to the present invention comprises: an electromagnet; a pair of armatures which are individually pivotably arranged at the right and left positions of the electromagnet and are symmetrically rotated by the attractive forces of the electromagnet against a return spring; and a pair of contact mechanisms which are respectively closed or opened due to the rotation of those armatures.

With this constitution, a pair of armatures can be respectively independently returned. Therefore, even if one of the contact mechanisms was not unexpectedly opened, the other contact mechanmism can be certainly opened irrespective of the closed state of the above one contact mechanism. On the other hand, the double armature structure has been used so as to obtain an effect similar to that in the case where two electromagnetic relays of the single pole type were used. However, it is sufficient to use only a single electromagnet to drive the armatures and it is also sufficient to use various kinds of parts such as coil terminals, base, etc. for one relay, so that the manufacturing cost can be reduced.

DESCRIPTION OF THE PREFERRED EMBODIMENTS

The present invention will be described in detail hereinbelow on the basis of embodiments shown in the diagrams.

Figure 1:
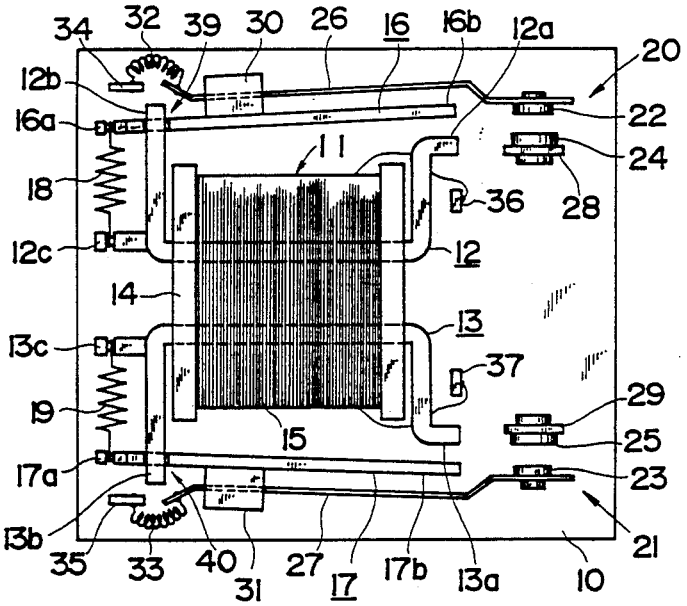
FIG. 1 is a plan view of an electromagnetic relay according to an embodiment of the present invention.
Figure 2:
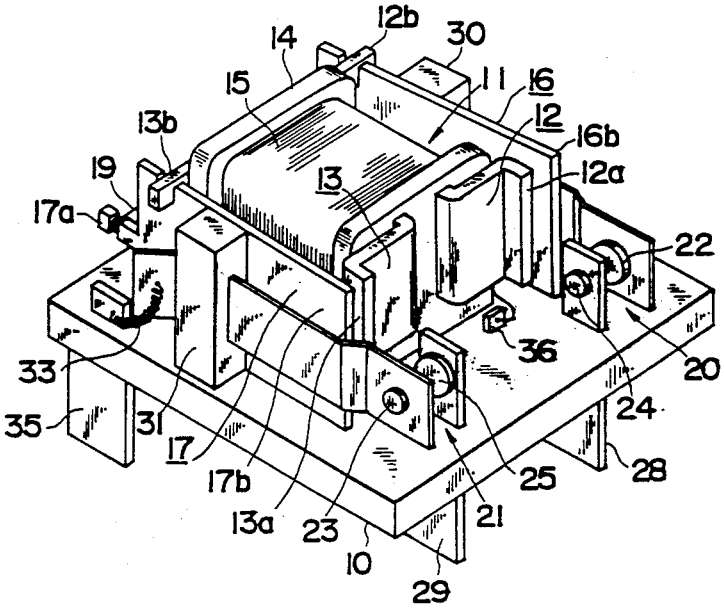
FIG. 2 is a perspective view of the same electromagnetic relay.

FIG. 1 is a plan view of an electromagnetic relay according to an embodiment of the present invention. FIG. 2 is a perspective view thereof.

In these diagrams, reference numeral 10 denotes a base made of an insulative material. An electromagnet 11 arranged over the base 10 has two iron cores 12 and 13. A coil 15 is wound around the central portion of the iron cores 12 and 13 through a spool 14. Both end portions 12*a* and 12*b* of the iron core 12 which are projected from the coil 15 and both end portions 13*a* and 13*b* of the iron core 13 are bent in the opposite directions and are arranged symmetrically at the right and left positions.

A pair of armatures 16 and 17 are arranged at the right and left positions of the electromagnet 11. The armature 16 is independently rotatably or pivotably supported to the end portion 12*b* of the iron core 12 through a hinge. The armature 17 is also independently rotatably supported to the end portion 13*b* of the iron core 13 through a hinge. A return spring 18 is fixed at one end to a projecting member 12*c* of the iron core 12. The return spring 18 stretches at the other end a projecting member 16*a* of the armature 16, thereby urging an edge portion 16*b* of the armature 16 so as to be away from the other end portion 12*a* of the iron core 12. A return spring 19 is attached between a projecting member 17*a* of the armature 17 and a projecting member 13*c* of the iron core 13. An edge portion 17*b* of the armature 17 is urged so as to be away from the other end portion 13*a* of the iron core 13 by the return spring 19.

A pair of contact mechanisms 20 and 21 have movable contacts 22 and 23 and fixed contacts 24 and 25 which face the movable contacts 22 and 23, respectively. The movable contact 22 is attached to the end portion of a movable contact member 26. The movable contact 23 is attached to the end portion of a movable contact member 27. The fixed contacts 24 and 25 are attached to first contact terminals 28 and 29. The movable contact members 26 and 27 are made of conductive leaf springs. The base portion sides of the movable contact members 26 and 27 are attached to the armatures 16 and 17 by insulative members 30 and 31 and are conductive to second contact terminals 34 and 35 via flexible lead wires 32 and 33, respectively. The second contact terminals 34 and 35, first contact terminals 28 and 29, and coil terminals 36 and 37 of the electromagnet 11 are molded so as to penetrate the base 10.

Figure 3:
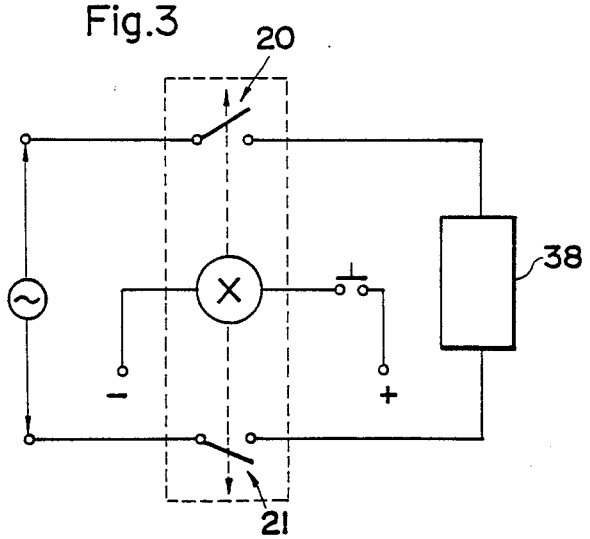
FIG. 3 is a diagram of an electric circuit using the same electromagnetic relay.

On the other hand, FIG. 3 shows an example in which the contact mechanisms 20 and 21 of the electromagnetic relay with the foregoing constitution are used as a double pole single throw switch in a power supply circuit of an electric apparatus 38.

Figure 4:
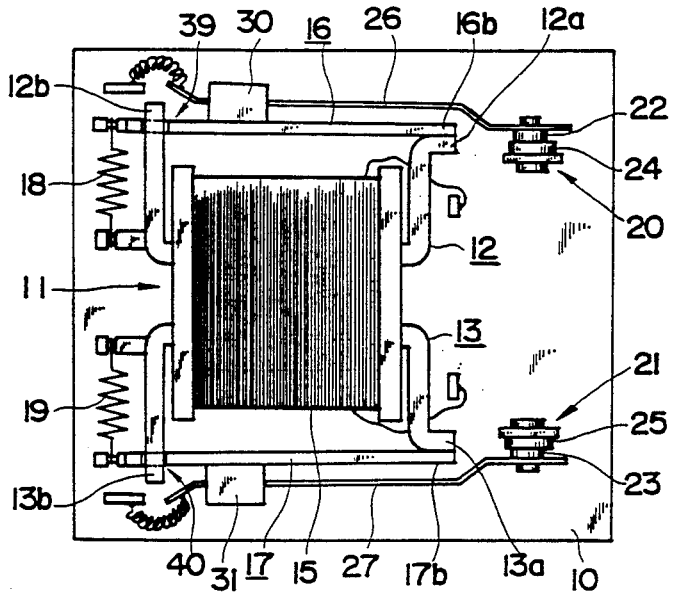
FIG. 4 is an operation diagram corresponding to FIG. 1.

The operation of this embodiment will now be explained. In FIG. 1, when the coil 15 is excited, attracting forces adapted to overcome the return springs 18 and 19 act between the edge portion 16*b* of the armature 16 and the end portion 12*a* of the iron core 12 and between the edge portion 17*b* of the armature 17 and the end portion 13*a* of the iron core 13, respectively. Thus, the armatures 16 and 17 are symmetrically rotated. Namely, as shown in FIG. 4, the armature 16 is rotated clockwise around a hinge portion 39 and adsorbed to the end portion 12*a* of the iron core 12. At the same time, the armature 17 is rotated counterclockwise around a hinge portion 40 and adsorbed to the end portion 13*a* of the iron core 13. When the armatures 16 and 17 are adsorbed, the movable contact 22 is come into contact with the fixed contact 24 and the movable contact 23 is come into contact with the fixed contact 25, respectively. Thus, the contact mechanisms 20 and 21 are closed.

When the current supply to the coil 15 is stopped after that, the edge portion 16*b* and 17*b* of the armatures 16 and 17 are away from the end portions 12*a* and 13*a* of the iron cores 12 and 13 by the spring forces of the return springs 18 and 19 and rotationally returned to the states shown in FIG. 2. Thus, the movable contact 22 is away from the fixed contact 24 and the movable contact 23 is away from the fixed contact 25, respectively, to thereby open the contact mechanisms 20 and 21. Even if the contact mechanism 20 (or 21) was not opened by the melt-bonding of the contacts or the like, the other contact mechanism 21 (or 20) is opened since the armature 17 (or 16) is rotated and returned by the return spring 19 (or 18). Therefore, the power supply circuit in FIG. 3 is certainly shut off and no current flows through the electric apparatus 38.

Figure 5:
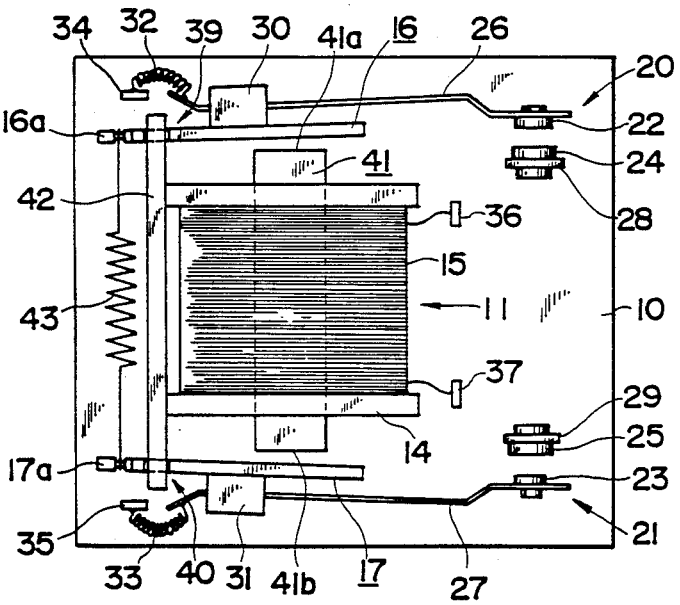
FIG. 5 is a plan view of an electromagnetic relay according to another embodiment of the present invention.
Figure 6:
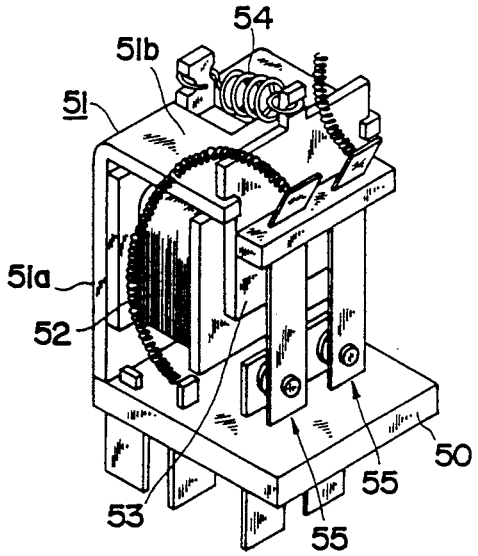
FIG. 6 is a perspective view of a conventional electromagnetic relay.
Figure 7:
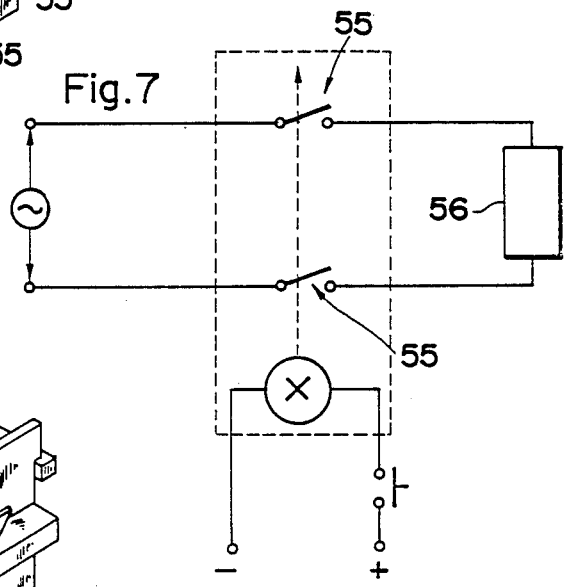
FIG. 7 is a diagram of an electric circuit using the conventional electromagnetic relay.
Figure 8:
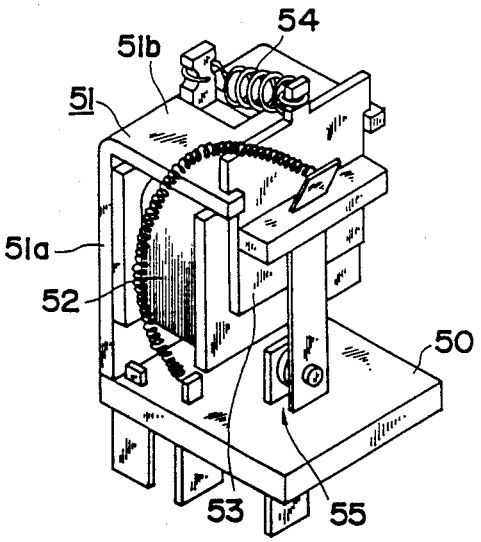
FIG. 8 is a perspective view of another conventional electromagnetic relay.

FIG. 5 shows a plan view of an electromagnetic relay according to another embodiment of the present invention. In FIG. 5, the same or corresponding parts and components as those shown in FIG. 1 are designated by the same reference numerals.

In the electromagnetic relay according to the embodiment of FIG. 5, an iron core 41 of the electromagnet 11 is formed of a single rod. The pair of armatures 16 and 17 face both end portions 41*a* and 41*b* of the iron core 41 and are independently rotatably supported to a yoke 42 by hinges, respectively. Further, the armatures 16 and 17 are rotated and returned by a single return spring 43 attached therebetween. A way of attaching the movable contact members 26 and 27 to the armatures 16 and 17 and structures of the contact mechanisms 20 and 21 are substantially the same as those in the first embodiment stated above.

Namely, although the detailed descriptions are omitted, as will be obvious from FIG. 5, the armatures 16 and 17 are symmetrically rotated and adsorbed to both end portions 41a and 41b of the iron core 41, so that the contact mechanisms 20 and 21 are closed. On the other hand, even if the contact mechanism 20 (or 21) was not opened due to an unexpected accident, the other contact mechanism 21 (or 20) is opened by the independent rotating and returning functions of the armature 17 (or 16).

Although above embodiments referes to electromagnetic relays of normally-open type, the present invention is also applicable to that of normally-closed type.

What is claimed is:

1. An electromagnetic relay comprising:

an electromagnet;

a pair of armatures which are individually rotatably arranged at right and left positions of said electromagnet and which are symmetrically rotated by attractive forces produced by the electromagnet; and a pair of contact mechanisms which are closed or opened by the rotation of said armatures, respectively, wherein said electromagnet comprises a pair of separately to attract respectively said pair of armatures.

2. The electromagnetic relay of claim 1, wherein the armatures are symmetrically rotated by attractive forces of the electromagnet against a return spring.

* * * * *